US010132059B2

(12) United States Patent
Kubo

(10) Patent No.: US 10,132,059 B2
(45) Date of Patent: Nov. 20, 2018

(54) FLUID PRESSURE CONTROL DEVICE

(71) Applicant: KYB Corporation, Tokyo (JP)

(72) Inventor: Syunsuke Kubo, Gifu (JP)

(73) Assignee: KYB Corporation, Tokyo (JP)

( * ) Notice: Subject to any disclaimer, the term of this patent is extended or adjusted under 35 U.S.C. 154(b) by 219 days.

(21) Appl. No.: 15/101,060

(22) PCT Filed: Dec. 2, 2014

(86) PCT No.: PCT/JP2014/081897
§ 371 (c)(1),
(2) Date: Jun. 2, 2016

(87) PCT Pub. No.: WO2015/087744
PCT Pub. Date: Jun. 18, 2015

(65) Prior Publication Data

US 2017/0022688 A1 Jan. 26, 2017

(30) Foreign Application Priority Data

Dec. 11, 2013 (JP) ..... 2013-255853

(51) Int. Cl.

| | |
|---|---|
| ***F15B 13/00*** | (2006.01) |
| ***E02F 9/22*** | (2006.01) |
| ***F15B 13/01*** | (2006.01) |
| ***E02F 3/42*** | (2006.01) |
| ***F15B 11/08*** | (2006.01) |

(Continued)

(52) U.S. Cl.
CPC ..... *E02F 9/2285* (2013.01); *E02F 3/422* (2013.01); *E02F 9/2225* (2013.01); *E02F 9/2267* (2013.01); *F15B 11/08* (2013.01); *F15B 13/015* (2013.01); *F15B 13/0426* (2013.01); *E02F 3/32* (2013.01); *E02F 9/2292* (2013.01); *F15B 2211/205* (2013.01); *F15B 2211/30* (2013.01)

(58) Field of Classification Search
CPC ..... E02F 3/32; E02F 9/2267
See application file for complete search history.

(56) References Cited

U.S. PATENT DOCUMENTS 6,253,658 B1 * 7/2001 Kimura ..... E02F 9/226 91/447
2015/0096291 A1 * 4/2015 Takeuchi ..... E02F 9/2203 60/460

FOREIGN PATENT DOCUMENTS

| | | |
|---|---|---|
| EP | 2949949 A1 | 12/2015 |
| JP | 2010-101400 A | 5/2010 |
| WO | WO 2013-146666 A1 | 10/2013 |

* cited by examiner

*Primary Examiner* — Thomas E Lazo
(74) *Attorney, Agent, or Firm* — Rabin & Berdo, P.C.

(57) ABSTRACT

A fluid pressure control device includes a load holding mechanism that is configured to hold the load pressure of the load side pressure chamber. The load holding mechanism includes a switching valve having a communication passage configured to be blocked from the third pressure chamber by the second land section in a case where the spool is closed, and providing communicate between the second supply port and the discharge port in accordance with the movement of the spool in the valve opening direction. In a case where the spool is moved in the valve opening direction, at the same time when or after the second supply port communicates with the discharge port via the communication passage, the first land section is brought into sliding contact with the annular projecting section and the first supply port and the discharge port are blocked from each other.

5 Claims, 4 Drawing Sheets

(51) Int. Cl.
*F15B 13/042* (2006.01)
*E02F 3/32* (2006.01)

FLUID PRESSURE CONTROL DEVICE

TECHNICAL FIELD

The present invention relates to a fluid pressure control device that controls an action of hydraulic working equipment.

BACKGROUND ART

As a fluid pressure control device that controls an action of hydraulic working equipment, JP2010-101400A discloses a fluid pressure control device including a cylinder to be extended and contracted by a working fluid supplied from a pump to drive a load, a control valve that switches between supply and discharge of the working fluid to and from the cylinder to control an extending/contracting action of the cylinder, and a load holding mechanism placed in a main passage that connects a load side pressure chamber of the cylinder and the control valve.

The load holding mechanism includes an operation check valve, and a switching valve to be activated by pilot pressure to switch an action of the operation check valve. The switching valve includes three ports of a first supply port to which a bypass passage bypassing the operation check valve is connected, a second supply port connected to a back pressure passage communicating with a back pressure chamber of the operation check valve, and a discharge port communicating with a control valve.

The switching valve can be switched to three switching positions of a blocking position, a first communication position, and a second communication position in accordance with a moving amount of a spool changed by pilot pressure, and the ports are opened and closed in accordance with the switching positions.

In a case where the switching valve is at the blocking position, the ports are closed.

In a case where the switching valve is at the first communication position, the first supply port and the discharge port communicate with each other. Thereby, the working fluid of the bypass passage is discharged from the discharge port.

In a case where the switching valve is at the second communication position, the first supply port and the second supply port, and the discharge port communicate with each other. Thereby, the working fluid of the bypass passage is discharged from the discharge port, and the working fluid of the back pressure passage is discharged from the discharge port.

SUMMARY OF INVENTION

In the above technique, at the time of switching the switching valve from the first communication position to the second communication position, the first supply port remains opened. Thus, due to an influence of a flow of the working fluid from the first supply port to the discharge port, pressure resistance is generated in the back pressure passage of the operation check valve. Thereby, there is a possibility that the working fluid of the back pressure passage is not discharged and the operation check valve is not sufficiently opened.

An object of the present invention is to provide a fluid pressure control device in which an operation check valve can be stably opened at the time of switching a switching valve.

According to one aspect of the present invention, the fluid pressure control device includes a cylinder configured to be extended and contracted by a working fluid supplied from a pump to drive a load; a control valve configured to switch between supply and discharge of the working fluid to and from the cylinder to control an extending/contracting action of the cylinder; a pilot valve configured to guide pilot pressure to the control valve; a main passage configured to connect a load side pressure chamber of the cylinder on which load pressure by the load acts in a case where the control valve is at a blocking position, and the control valve; and a load holding mechanism placed in the main passage, the load holding mechanism being configured to hold the load pressure of the load side pressure chamber in a case where the control valve is at the blocking position. The load holding mechanism includes an operation check valve configured to allow a flow of the working fluid from the control valve to the load side pressure chamber, and allows a flow of the working fluid from the load side pressure chamber to the control valve in accordance with pressure of a back pressure chamber to which the pressure of the load side pressure chamber is guided via a throttle passage; and a switching valve configured to be activated in conjunction with the control valve by the pilot pressure guided through the pilot valve to switch work of the operation check valve. The switching valve includes a pilot chamber configured to which the pilot pressure is guided through the pilot valve; a spool configured to be moved in the valve opening direction in accordance with the pilot pressure of the pilot chamber, the spool having a poppet section, a first land section, and a second land section in order from the front end side in the valve opening direction; a bias member configured to bias the spool in the valve closing direction against the pilot pressure of the pilot chamber; a spool hole having an annular projecting section on an inner periphery, the annular projecting section on which the poppet section is configured to be seated in a case where the spool is closed, the annular projecting section with which an outer periphery of the first land section is configured to be brought into sliding contact by moving the spool in the valve opening direction; a first supply port configured to guide the working fluid from the load side pressure chamber to the spool hole while letting the working fluid bypass the operation check valve; a second supply port configured to guide the working fluid from the back pressure chamber to the spool hole; a discharge port configured to communicate with the first supply port or the second supply port in accordance with movement of the spool in the valve opening direction to discharge the working fluid; a first pressure chamber in which the discharge port is opened; a second pressure chamber configured to be blocked from the first pressure chamber by seating the poppet section on the annular projecting section; a third pressure chamber in which the first supply port is opened, the third pressure chamber configured to be blocked from the second pressure chamber by the first land section in a case where the spool is closed, and to communicate with the second pressure chamber in accordance with the movement of the spool in the valve opening direction; and a communication passage configured to be blocked from the third pressure chamber by the second land section in a case where the spool is closed, and to provide communicate between the second supply port and the discharge port in accordance with the movement of the spool in the valve opening direction. In a case where the spool is moved in the valve opening direction, at the same time when or after the second supply port communicates with the discharge port via the communication passage, the first land section is brought into sliding contact with the annular projecting section and the first supply port and the discharge port are blocked from each other.

DESCRIPTION OF EMBODIMENTS

Hereinafter, embodiments of the present invention are described with reference to the accompanying drawings.

A fluid pressure control device 100 is to control an action of hydraulic working equipment such as a hydraulic excavator. In the present embodiment, a case of controlling an extending/contracting action of a cylinder 2 that drives an arm (load) 1 of a hydraulic excavator shown in FIG. 1 will be described.

Figure 2:
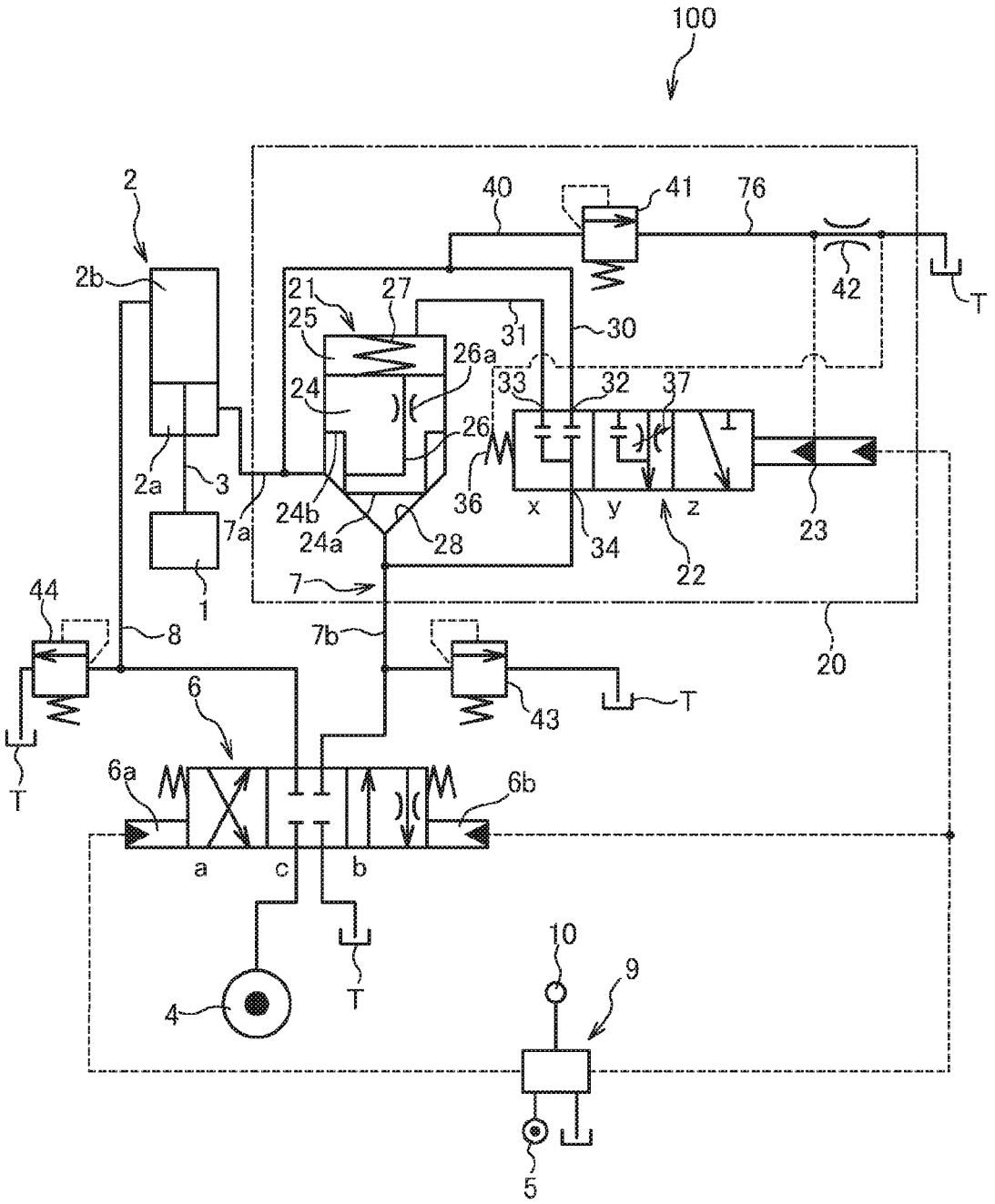
FIG. 2 is a hydraulic circuit diagram of a fluid pressure control device according to an embodiment of the present invention.

Firstly, with reference to FIG. 2, a hydraulic circuit of the hydraulic control device 100 will be described.

The cylinder 2 is partitioned into a rod side pressure chamber 2*a* and a non-rod side pressure chamber 2*b* by a piston rod 3 that slidably moves in the cylinder 2.

An engine is installed in the hydraulic excavator, and a pump 4 and a pilot pump 5 serving as hydraulic sources are driven by power of the engine.

Working oil (working fluid) discharged from the pump 4 is supplied to the cylinder 2 through a control valve 6.

The control valve 6 and the rod side pressure chamber 2*a* of the cylinder 2 are connected by a first main passage 7, and the control valve 6 and the non-rod side pressure chamber 2*b* of the cylinder 2 are connected by a second main passage 8.

The control valve 6 is operated by pilot pressure oil supplied from the pilot pump 5 to pilot chambers 6*a*, 6*b* through a pilot valve 9 as a passenger of the hydraulic excavator manually operates an operation lever 10.

Specifically, in a case where the pilot pressure is guided to the pilot chamber 6*a*, the control valve 6 is switched to a position a, the working oil is supplied from the pump 4 to the rod side pressure chamber 2*a* through the first main passage 7, and the working oil in the non-rod side pressure chamber 2*b* is discharged to a tank T through the second main passage 8. Thereby, the cylinder 2 performs a contracting action, and the arm 1 is raised in the direction of an arrow 80 shown in FIG. 1.

Meanwhile, in a case where the pilot pressure is guided to the pilot chamber 6*b*, the control valve 6 is switched to a position b, the working oil is supplied from the pump 4 to the non-rod side pressure chamber 2*b* through the second main passage 8, and the working oil of the rod side pressure chamber 2*a* is discharged to the tank T through the first main passage 7. Thereby, the cylinder 2 performs an extending action, and the arm 1 is lowered in the direction of an arrow 81 shown in FIG. 1.

In a case where the pilot pressure is not guided to the pilot chambers 6*a*, 6*b*, the control valve 6 is switched to a position c, supply and discharge of the working oil to and from the cylinder 2 are blocked, and the arm 1 is maintained in a stopped state.

In such a way, the control valve 6 includes three switching positions of the contracting position a at which the cylinder 2 performs the contracting action, the extending position b at which the cylinder 2 performs the extending action, and the blocking position c at which the load of the cylinder 2 is held, switches the supply and the discharge of the working oil to and from the cylinder 2, and controls the extending/contracting action of the cylinder 2.

Figure 1:
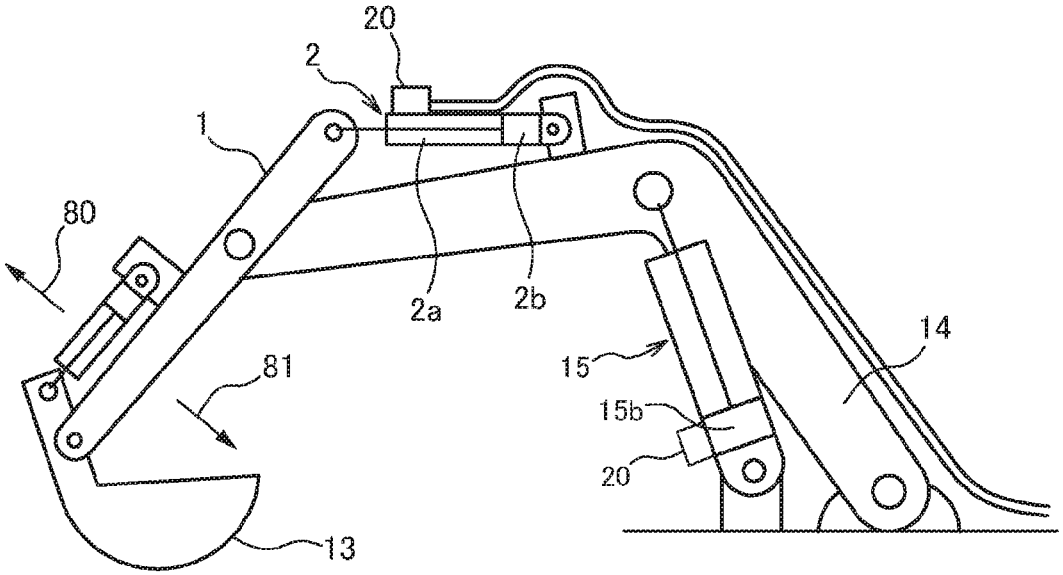
FIG. 1 is a view showing one part of a hydraulic excavator.

As shown in FIG. 1, in a case where movement of the arm 1 is stopped by switching the control valve 6 to the blocking position c in a state where a bucket 13 is brought up, force in the direction of extending acts on the cylinder 2 due to self-weight of the bucket 13, the arm 1, and the like. In such a way, in the cylinder 2 that drives the arm 1, the rod side pressure chamber 2*a* serves as a load side pressure chamber on which load pressure acts in a case where the control valve 6 is at the blocking position c.

A load holding mechanism 20 is placed in the first main passage 7 connected to the rod side pressure chamber 2*a* on the load side. The load holding mechanism 20 is to hold the load pressure of the rod side pressure chamber 2*a* in a case where the control valve 6 is at the blocking position c, and is fixed to a surface of the cylinder 2 as shown in FIG. 1.

In a cylinder 15 that drives a boom 14, a non-rod side pressure chamber 15*b* serves as the load side pressure chamber. Thus, in a case where a load holding mechanism 20 is provided in the boom 14, the load holding mechanism 20 is placed in a main passage connected to the non-rod side pressure chamber 15*b* (refer to FIG. 1).

The load holding mechanism 20 includes an operation check valve 21 placed in the first main passage 7, and a meter-out control valve 22 to be activated in conjunction with the control valve 6 by the pilot pressure oil supplied to a pilot chamber 23 through the pilot valve 9 to switch work of the operation check valve 21.

The operation check valve 21 includes a valve body 24 that opens and closes the first main passage 7, a seat section 28 on which the valve body 24 is seated, a back pressure chamber 25 formed on a back surface of the valve body 24, and a throttle passage 26 formed in the valve body 24, the throttle passage that always guides the working oil of the rod side pressure chamber 2*a* to the back pressure chamber 25. A throttle 26*a* is placed in the throttle passage 26.

The first main passage 7 is divided into a cylinder side first main passage 7*a* and a control valve side first main passage 7*b* by the valve body 24. The cylinder side first main passage 7*a* connects the rod side pressure chamber 2*a* and the operation check valve 21, and the control valve side first main passage 7*b* connects the operation check valve 21 and the control valve 6.

A first pressure receiving surface 24*a* on which pressure of the control valve side first main passage 7*b* acts, and a second pressure receiving surface 24*b* on which the pressure of the rod side pressure chamber 2*a* acts through the cylinder side first main passage 7*a* are formed on the valve body 24.

A spring 27 serving as a bias member that biases the valve body 24 in the valve closing direction is housed and installed in the back pressure chamber 25. In such a way, pressure of the back pressure chamber 25 and bias force of the spring 27 act in the direction of seating the valve body 24 on the seat section 28.

In a state where the valve body 24 is seated on the seat section 28, the operation check valve 21 exerts a function as a check valve that blocks a flow of the working oil from the rod side pressure chamber 2*a* to the control valve 6. That is, the operation check valve 21 prevents leakage of the working oil in the rod side pressure chamber 2*a* to hold the load pressure and to hold a stopped state of the arm 1.

The load holding mechanism 20 includes a bypass passage 30 that guides the working oil of the rod side pressure chamber 2*a* to the control valve side first main passage 7*b* while letting the working oil bypass the operation check valve 21, and a back pressure passage 31 that guides the working oil of the back pressure chamber 25 to the control valve side first main passage 7*b*.

The meter-out control valve 22 is placed in the bypass passage 30 and the back pressure passage 31, and switches communication of the control valve side first main passage 7*b* with the bypass passage 30 and the back pressure passage 31 to control a flow of the working oil of the first main passage 7 on the meter-out side when the cylinder 2 performs the extending action.

The meter-out control valve 22 includes three ports of a first supply port 32 communicating with the bypass passage 30, a second supply port 33 communicating with the back pressure passage 31, and a discharge port 34 communicating with the control valve side first main passage 7*b*.

The meter-out control valve 22 includes three switching positions of a blocking position x, a first communication position y, and a second communication position z.

When the pilot pressure is guided to the pilot chamber 6*b* of the control valve 6, pilot pressure of the same pressure is guided to the pilot chamber 23 at the same time. That is, in a case where the control valve 6 is switched to the extending position b, the meter-out control valve 22 is also switched to the first communication position y or the second communication position z.

Specifically speaking, in a case where the pilot pressure is not guided to the pilot chamber 23, the meter-out control valve 22 is maintained at the blocking position x by bias force of a spring 36 serving as a bias member. At the blocking position x, both the first supply port 32 and the second supply port 33 are blocked.

In a case where the pilot pressure less than predetermined pressure is guided to the pilot chamber 23, the meter-out control valve 22 is switched to the first communication position y. At the first communication position y, the first supply port 32 communicates with the discharge port 34. Thereby, the working oil of the rod side pressure chamber 2*a* is guided from the bypass passage 30 to the control valve side first main passage 7*b* through the meter-out control valve 22. That is, the working oil of the rod side pressure chamber 2*a* is guided to the control valve side first main passage 7*b* while bypassing the operation check valve 21. At this time, resistance is given to the flow of the working oil by throttles 37. The second supply port 33 is maintained in a blocked state.

In a case where the pilot pressure of the predetermined pressure or more is guided to the pilot chamber 23, the meter-out control valve 22 is switched to the second communication position z. At the second communication position z, the first supply port 32 is blocked, and the second supply port 33 communicates with the discharge port 34. Thereby, the working oil of the back pressure chamber 25 is guided from the back pressure passage 31 to the control valve side first main passage 7*b* through the meter-out control valve 22.

On the upstream of the meter-out control valve 22 in the bypass passage 30, a relief passage 40 is connected to branch from. A relief valve 41 to be opened in a case where the pressure of the rod side pressure chamber 2*a* reaches predetermined pressure to allow passage of the working oil and to release the working oil of the rod side pressure chamber 2*a* is placed in the relief passage 40. The working oil passing through the relief valve 41 is discharged to the tank T through a discharge passage 76. An orifice 42 is placed in the discharge passage 76, and pressure on the upstream side of the orifice 42 is guided to the pilot chamber 23. The meter-out control valve 22 is set to be switched to the second communication position z by pressure of relief pressure oil guided to the pilot chamber 23 through the relief valve 41.

A first main relief valve 43 is connected to the control valve side first main passage 7*b*, and a second main relief valve 44 is connected to the second main passage 8. The first main relief valve 43 and the second main relief valve 44 are to release high pressure generated in the rod side pressure chamber 2*a* and the non-rod side pressure chamber 2*b* of the cylinder 2 when large external force acts on the arm 1.

Figure 3:
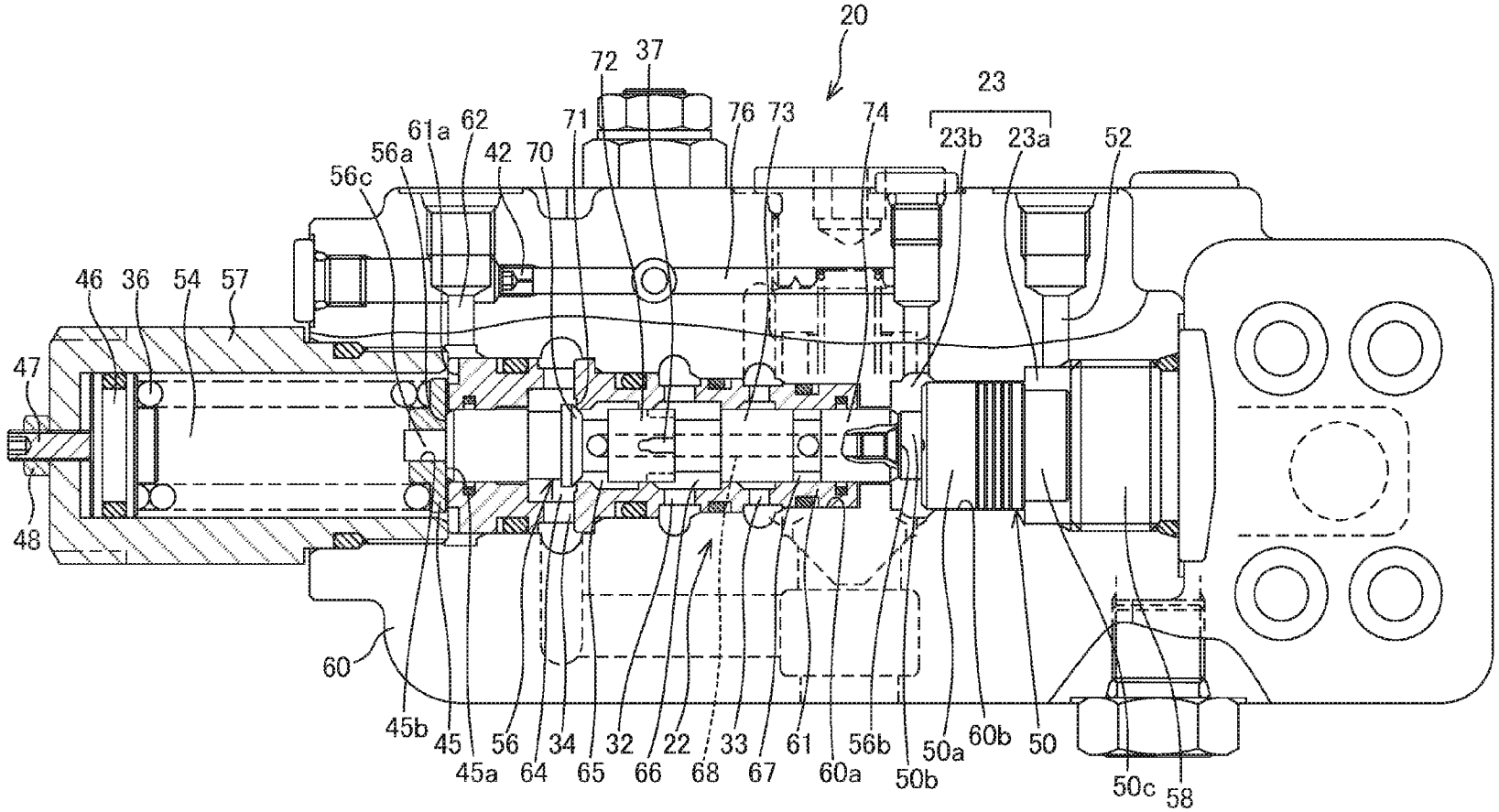
FIG. 3 is a sectional view of a load holding mechanism of the fluid pressure control device according to the embodiment of the present invention.
Figure 4:
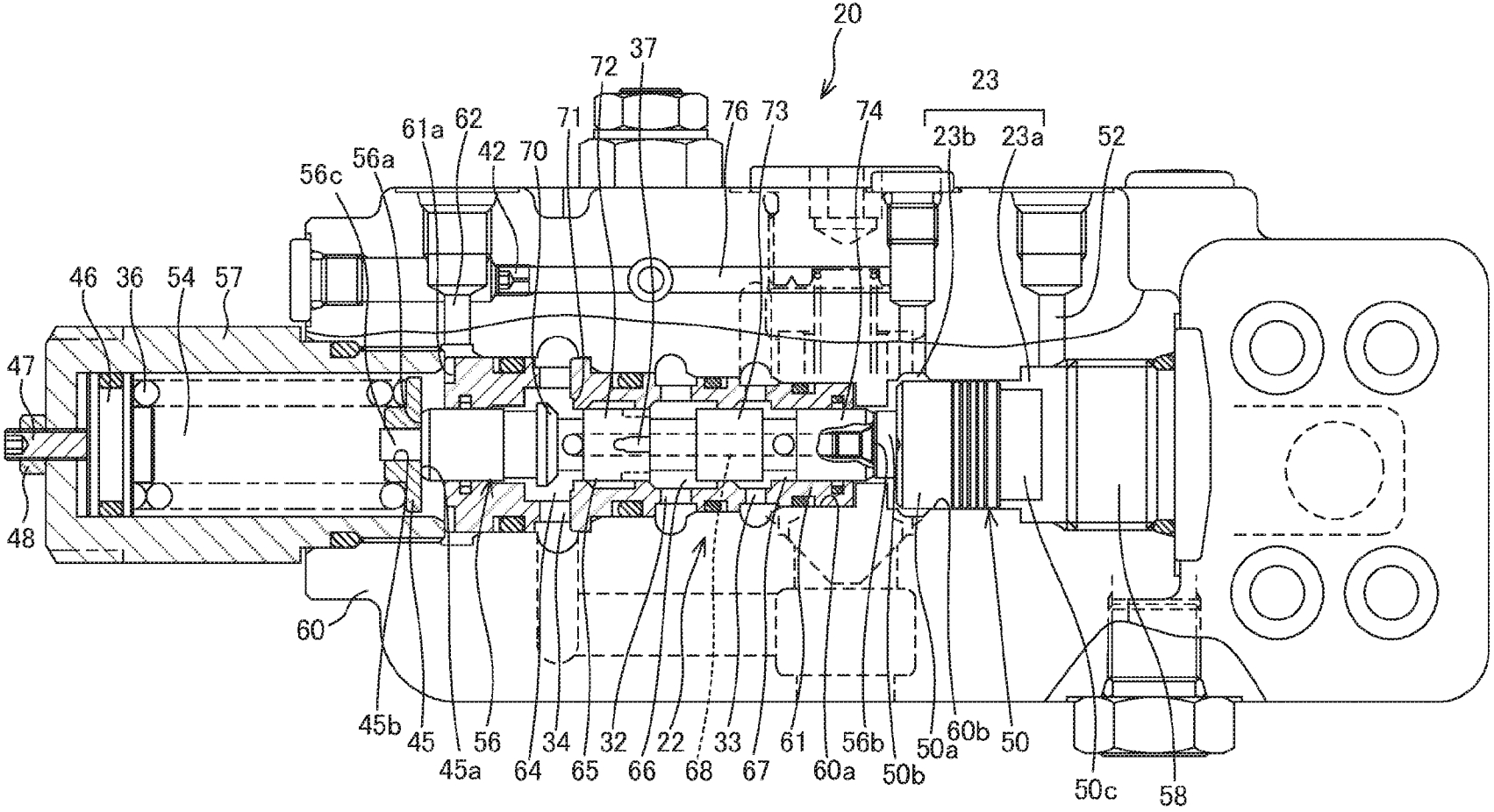
FIG. 4 is a sectional view of the load holding mechanism of the fluid pressure control device according to the embodiment of the present invention.

Next, mainly with reference to FIGS. 3 and 4, the meter-out control valve 22 will be described in detail. FIG. 3 is a sectional view of the load holding mechanism 20 showing a state where the pilot pressure is not guided to the pilot chamber 23 and the meter-out control valve 22 is at the blocking position x. FIG. 4 is a sectional view of the load holding mechanism 20 showing a state where the pilot pressure is guided to the pilot chamber 23 and the meter-out control valve 22 is at the blocking position z. In FIGS. 3 and 4, members having the same reference signs as the reference signs shown in FIG. 2 have the same configurations as the configurations shown in FIG. 2.

The meter-out control valve 22 is assembled into a body 60. A spool hole 60*a* is formed in the body 60, and a substantially cylindrical sleeve 61 is inserted into the spool hole 60*a*. A spool 56 is slidably assembled into the sleeve 61.

A spring chamber 54 partitioned by a cap 57 is formed on the side of one end surface 56*a* of the spool 56. The spring chamber 54 communicates with the downstream side of the orifice 42 (refer to FIG. 2) through a cutout 61*a* formed on an end surface of the sleeve 61 and a passage 62 formed in the body 60, and is connected to the tank T.

The spring 36 serving as a bias member that biases the spool 56 is housed and installed in the spring chamber 54. An annular first spring receiving member 45 in which an end surface 45*a* thereof is abutted with the one end surface 56*a* of the spool 56 and a pin section 56*c* formed to project from the one end surface 56*a* of the spool 56 is inserted into a hollow section 45*b* thereof, and a second spring receiving member 46 arranged in the vicinity of a bottom part of the cap 57 are also housed and installed in the spring chamber 54. The spring 36 is placed between the first spring receiving member 45 and the second spring receiving member 46 in a compressed state, and biases the spool 56 in the valve closing direction via the first spring receiving member 45.

An axial position of the second spring receiving member 46 in the spring chamber 54 is set by abutting a front end of an adjustment bolt 47 passing through the bottom part of the cap 57 to be screwed with a back surface of the second spring receiving member 46. By screwing the adjustment bolt 47, the second spring receiving member 46 is moved in the direction in which the second spring receiving member comes close to the first spring receiving member 45. Therefore, by adjusting a screwing amount of the adjustment bolt 47, an initial spring load of the spring 36 can be adjusted. The adjustment bolt 47 is fixed by a nut 48.

On the side of the other end surface 56*b* of the spool 56, the pilot chamber 23 is formed by a piston hole 60*b* formed to communicate with the spool hole 60*a* and a cap 58 that closes the piston hole 60*b*. A piston 50 that receives the pilot pressure on a back surface thereof and gives thrust force against the bias force of the spring 36 to the spool 56 is slidably inserted into the pilot chamber 23.

The pilot chamber 23 is partitioned into a first pilot chamber 23*a* facing the back surface of the piston 50 and a second pilot chamber 23*b* facing a front surface of the piston 50 and the other end surface 56*b* of the spool 56 by the piston 50. The pilot pressure oil from the pilot valve 9 is supplied to the first pilot chamber 23*a* through a passage 52 formed in the body 60. The relief pressure oil passing through the relief valve 41 is guided to the second pilot chamber 23*b* through the discharge passage 76.

The piston 50 includes a sliding section 50*a* whose outer peripheral surface slides along an inner peripheral surface of the piston hole 60*b*, a front end 50*b* formed to have a smaller diameter than that of the sliding section 50*a*, the front end facing the other end surface 56*b* of the spool 56, and a base end 50*c* formed to have a smaller diameter than that of the sliding section 50*a*, the base end facing the front end surface of the cap 58.

When the pilot pressure oil is supplied into the first pilot chamber 23*a* through the passage 52, the pilot pressure acts on a back surface of the base end 50*c* and an annular back surface of the sliding section 50*a*. Thereby, the piston 50 goes forward and the front end 50*b* is abutted with the other end surface 56*b* of the spool 56, so that the spool 56 is moved. In such a way, the spool 56 receives the thrust force of the piston 50 generated on the basis of the pilot pressure acting on the back surface of the piston 50, and is moved in the valve opening direction against the bias force of the spring 36.

When the relief pressure oil passing through the relief valve 41 is guided into the second pilot chamber 23*b* through the discharge passage 76, the pressure of the relief pressure oil acts on the other end surface 56*b* of the spool 56. Thereby, the spool 56 is moved against the bias force of the spring 36, and the meter-out control valve 22 is switched to the second communication position z. At this time, since the pressure of the relief pressure oil also acts on the piston 50, the piston 50 retreats and is abutted with the cap 58.

The spool 56 stops at a position where the bias force of the spring 36 acting on the one end surface 56*a* and the thrust force of the piston 50 acting on the other end surface 56*b* are balanced. The switching position of the meter-out control valve 22 is set at the stopping position of the spool 56. The spool 56 is moved in the valve opening direction when the thrust force of the piston 50 is greater than the bias force of the spring, and moved in the valve closing direction when the bias force of the spring is greater than the thrust force of the piston 50.

An outer peripheral surface of the spool 56 is partially cut out into an annular shape, and a poppet section 70, a first land section 72, a second land section 73, and a third land section 74 are formed in order from the front end side in the valve opening direction. The poppet section 70 has a larger outer diameter than those of the first land section 72, the second land section 73, and the third land section 74, and is formed into a tapered shape with the outer diameter increasing toward the valve opening direction.

An inner peripheral surface of the sleeve 61 is partially cut out into an annular shape, and the cut-out parts and the outer peripheral surface of the spool 56 form a first pressure chamber 64, a second pressure chamber 65, a third pressure chamber 66, and a fourth pressure chamber 67 in order from the front end side in the valve opening direction.

Further, the first supply port 32 communicating with the bypass passage 30 (refer to FIG. 2), the second supply port 33 communicating with the back pressure passage 31 (refer to FIG. 2), and the discharge port 34 communicating with the control valve side first main passage 7*b* are formed in the sleeve 61.

The first pressure chamber 64 always communicates with the discharge port 34.

The second pressure chamber 65 is blocked from the first pressure chamber 64 by seating the poppet section 70 on an annular projecting section 71 projecting from the inner peripheral surface of the sleeve 61 to the inner diameter side in an annular form.

The third pressure chamber 66 always communicates with the first supply port 32. The plurality of throttles 37 that provides communication between the third pressure chamber 66 and the second pressure chamber 65 by moving the spool 56 in the valve opening direction is formed on an outer periphery of the first land section 72 of the spool 56.

The fourth pressure chamber 67 serving as a communication passage always communicates with the second pressure chamber 65 via a conducting hole 68 formed in the spool 56 in the axial direction. One end of the conducting hole 68 serving as a communication passage is opened in the fourth pressure chamber and the other end is opened in the second pressure chamber 65. An opening part of the second supply port 33 is closed while facing an outer periphery of the second land section 73 in a case where the spool 56 is closed, and the second supply port communicates with the fourth pressure chamber 67 by moving the spool 56 in the valve opening direction.

In a case where the pilot pressure is not guided to the pilot chamber 23, the poppet section 70 formed in the spool 56 is pressed onto the annular projecting section 71 formed on an inner periphery of the sleeve 61 by the bias force of the spring 36, so that communication between the second pressure chamber 65 and the first pressure chamber 64 is blocked. Therefore, communication between the first supply port 32 and the discharge port 34 is blocked, and communication between the second supply port 33 and the discharge port 34 is also blocked. Thereby, the working oil of the rod side pressure chamber 2*a* and the working oil of the back pressure chamber 25 are not leaked out to the discharge port 34. This state corresponds to the blocking position x of the meter-out control valve 22. In a state where the poppet section 70 is seated on the annular projecting section 71 by the bias force of the spring 36, a slight gap exists between the end surface 45*a* of the first spring receiving member 45 and the end surface of the sleeve 61. Thus, the poppet section 70 is reliably seated on the annular projecting section 71 by the bias force of the spring 36.

In a case where the pilot pressure is guided to the first pilot chamber 23*a* and the thrust force of the piston 50 acting on the spool 56 becomes greater than the bias force of the spring 36, the spool 56 is moved in the valve opening direction against the bias force of the spring 36. Thereby, the poppet section 70 is taken away from the annular projecting section 71 and the third pressure chamber 66 and the second pressure chamber 65 communicate with each other through the plurality of throttles 37. Thus, the first supply port 32 communicates with the discharge port 34 through the third pressure chamber 66, the throttles 37, the second pressure chamber 65, and the first pressure chamber 64. By the communication between the first supply port 32 and the discharge port 34, the working oil of the rod side pressure chamber 2*a* is guided to the control valve side first main passage 7*b* via the throttles 37. This state corresponds to the first communication position y of the meter-out control valve 22.

When the pilot pressure guided to the first pilot chamber 23*a* is increased, the spool 56 is further moved in the valve opening direction against the bias force of the spring 36, and the second supply port 33 communicates with the fourth pressure chamber 67. Thereby, the second supply port 33 communicates with the discharge port 34 through the fourth pressure chamber 67, the conducting hole 68, and the first pressure chamber 64. By the communication between the second supply port 33 and the discharge port 34, the working oil of the back pressure chamber 25 is guided to the control valve side first main passage 7*b*. This state corresponds to the second communication position z of the meter-out control valve 22. When the spool 56 is further moved in the valve opening direction, the outer periphery of the first land section 72 is brought into sliding contact with an inner periphery of the annular projecting section 71 (refer to FIG. 4). Thereby, the communication between the first pressure chamber 64 and the second pressure chamber 65 is blocked. Therefore, the communication between the first supply port 32 and the discharge port 34 is blocked.

Next, actions of the hydraulic control device 100 will be described mainly with reference to FIGS. 2 to 4.

In a case where the control valve 6 is at the blocking position c, the working oil discharged by the pump 4 is not supplied to the cylinder 2. At this time, since the pilot pressure is not guided to the first pilot chamber 23*a* of the meter-out control valve 22, the meter-out control valve 22 is also at the blocking position x.

Therefore, the back pressure chamber 25 of the operation check valve 21 is maintained at the pressure of the rod side pressure chamber 2*a*. A pressure receiving area in the valve closing direction of the valve body 24 (area of the back surface of the valve body 24) is larger than an area of the second pressure receiving surface 24*b* serving as a pressure receiving area in the valve opening direction. Thus, by the pressure of the back pressure chamber 25 and the bias force of the spring 27, the valve body 24 is seated on the seat section 28. In such a way, by the operation check valve 21, leakage of the working oil in the rod side pressure chamber 2*a* is prevented and a stopped state of the arm 1 is held.

When the operation lever 10 is operated and the pilot pressure is guided from the pilot valve 9 to the pilot chamber 6*a* of the control valve 6, the control valve 6 is switched to the contracting position a by an amount in accordance with the pilot pressure. When the control valve 6 is switched to the contracting position a, the pressure of the working oil discharged by the pump 4 acts on the first pressure receiving surface 24*a* of the operation check valve 21. At this time, the pilot pressure is not guided to the pilot chamber 23 and the meter-out control valve 22 is at the blocking position x. Thus, the back pressure chamber 25 of the operation check valve 21 is maintained at the pressure of the rod side pressure chamber 2*a*. In a case where the load acting on the first pressure receiving surface 24*a* becomes greater than the sum of the load acting on the back surface of the valve body 24 by the pressure of the back pressure chamber 25 and the bias force of the spring 27, the valve body 24 is taken away from the seat section 28. In such a way, when the operation check valve 21 is opened, the working oil discharged from the pump 4 is supplied to the rod side pressure chamber 2*a*, so that the cylinder 2 is contracted. Thereby, the arm 1 is raised in the direction of the arrow 80 shown in FIG. 1.

When the operation lever 10 is operated and the pilot pressure is guided from the pilot valve 9 to the pilot chamber 6*b* of the control valve 6, the control valve 6 is switched to the extending position b by an amount in accordance with the pilot pressure. At the same time, the pilot pressure is also guided to the first pilot chamber 23*a*. Thus, the meter-out control valve 22 is switched to the first communication position y or the second communication position z in accordance with the supplied pilot pressure.

In a case where the pilot pressure guided to the first pilot chamber 23*a* is less than the predetermined pressure, the meter-out control valve 22 is switched to the first communication position y. In this case, the communication between the second supply port 33 and the discharge port 34 is blocked. Thus, the back pressure chamber 25 of the operation check valve 21 is maintained at the pressure of the rod side pressure chamber 2*a*, and the operation check valve 21 is closed.

Meanwhile, the first supply port 32 communicates with the discharge port 34. Thus, the working oil of the rod side pressure chamber 2*a* is guided from the bypass passage 30 to the control valve side first main passage 7*b* through the throttles 37, and discharged from the control valve 6 to the tank T. Since the working oil discharged by the pump 4 is supplied to the non-rod side pressure chamber 2*b*, the cylinder 2 is extended. Thereby, the arm 1 is lowered in the direction of the arrow 81 shown in FIG. 1.

The meter-out control valve 22 is switched to the first communication position y mainly in a case of performing a crane operation to get an item to be conveyed attached to the bucket 13 down to a target position. In the crane operation, there is a need for letting the cylinder 2 perform the extending action at low speed to slowly lower the arm 1 in the direction of the arrow 81. Thus, the control valve 6 is only switched to the extending position b to a slight extent. Therefore, the pilot pressure guided to the pilot chamber 6*b* of the control valve 6 is small, the pilot pressure guided to the first pilot chamber 23*a* of the meter-out control valve 22 is less than the predetermined pressure, and the meter-out control valve 22 is switched only to the first communication position y. Consequently, the working oil of the rod side pressure chamber 2*a* is discharged through the throttles 37, so that the arm 1 is lowered at low speed suitable for the crane operation.

In a case where the meter-out control valve 22 is at the first communication position y and even when a situation where the working oil is leaked out to an exterior due to burst of the control valve side first main passage 7*b* or the like is generated, a flow rate of the working oil discharged from the rod side pressure chamber 2*a* is restricted by the throttles 37. Thus, falling speed of the bucket 13 is not increased. This function is called as metering control. Therefore, before the bucket 13 falls down to the ground, the meter-out control valve 22 can be switched to the blocking position x, so that fall of the bucket 13 can be prevented.

In such a way, the throttles 37 are to suppress lowering speed of the cylinder 2 at the time of closing the operation check valve 21 and also to suppress the falling speed of the bucket 13 at the time of the burst of the control valve side first main passage 7*b*.

When the pilot pressure guided to the first pilot chamber 23*a* becomes the predetermined pressure or more, the meter-out control valve 22 is switched to the second communication position z. In this case, the communication between the first supply port 32 and the discharge port is blocked. Thus, a flow of the working oil of the bypass passage is blocked. Meanwhile, the second supply port 33 communicates with the discharge port 34. Thus, the working oil of the back pressure chamber 25 of the operation check valve 21 is guided from the back pressure passage 31 to the control valve side first main passage 7*b*, and discharged from the control valve 6 to the tank T. Thereby, differential pressure is generated before and after the throttle passage 26, and the pressure in the back pressure chamber 25 is reduced. Thus, force in the valve closing direction acting on the valve body 24 is reduced, the valve body 24 is taken away from the seat section 28, and the function of the operation check valve 21 as the check valve is canceled.

In such a way, the operation check valve 21 is activated to allow a flow of the working oil from the control valve 6 to the rod side pressure chamber 2*a*, and to allow a flow of the working oil from the rod side pressure chamber 2*a* to the control valve 6 in accordance with the pressure of the back pressure chamber 25.

When the operation check valve 21 is opened, the working oil of the rod side pressure chamber 2*a* is discharged to the tank T through the first main passage 7. Thus, the cylinder 2 is quickly extended. That is, when the meter-out control valve 22 is switched to the second communication position z, a flow rate of the working oil discharged from the rod side pressure chamber 2*a* is increased. Thus, a flow rate of the working oil supplied to the non-rod side pressure chamber 2*b* is increased and extending speed of the cylinder 2 is increased. Thereby, the arm 1 is quickly lowered in the direction of the arrow 81.

The meter-out control valve 22 is switched to the second communication position z in a case of performing an excavating operation or the like, and the control valve 6 is switched to the extending position b to a great extent. Therefore, the pilot pressure guided to the pilot chamber 6*b* of the control valve 6 is great, the pilot pressure guided to the first pilot chamber 23*a* of the meter-out control valve 22 becomes the predetermined pressure or more, and the meter-out control valve 22 is switched to the second communication position z.

In a case where the meter-out control valve 22 is at the first communication position y, the working oil flows from the first supply port 32 to the discharge port 34 via the third pressure chamber 66, the throttles 37, the second pressure chamber 65, and the first pressure chamber 64. In this state, when the meter-out control valve 22 is switched to the second communication position z and the second supply port 33 communicates with the fourth pressure chamber 67, the working oil flows from the fourth pressure chamber 67 to the second pressure chamber 65 via the conducting hole 68.

At this time, when the working oil flows from the first supply port 32 to the discharge port 34, a pressure loss is generated in a flow from the second pressure chamber 65 to the first pressure chamber 64. There is a possibility that this pressure becomes resistance, the working oil of the back pressure passage 31 is not discharged in an outlet of the conducting hole 68 in the second pressure chamber 65, and the operation check valve 21 is not sufficiently opened.

In the present embodiment, axial size of the first land section 72 is set to be long in such a manner that the outer periphery of the first land section 72 is brought into sliding contact with the inner periphery of the annular projecting section 71 at the same time when or after the second supply port 33 communicates with the fourth pressure chamber 67 by moving the spool 56 in the valve opening direction.

Thereby, in a case where the meter-out control valve 22 is switched from the first communication position y to the second communication position z, as shown in FIG. 4, the second supply port 33 and the discharge port 34 communicate with each other, and then the first supply port 32 and the discharge port 34 are blocked from each other by the sliding contact between the first land section 72 and the annular projecting section 71. Therefore, generation of pressure resistance in the outlet of the conducting hole 68 can be prevented.

According to the above embodiment, the following effects are exerted.

In a case where the spool 56 is moved in the valve opening direction and the meter-out control valve 22 is switched from the first communication position y to the second communication position z, at the same time when or after the second supply port 33 communicates with the discharge port 34 via the conducting hole 68, the outer periphery of the first land section 72 is brought into sliding contact with the inner periphery of the annular projecting section 71 and the first supply port 32 and the discharge port 34 are blocked from each other. Thereby, the generation of the pressure resistance in the outlet of the conducting hole 68 due to an influence of the flow of the working oil from the first supply port 32 to the discharge port 34 can be prevented, and the operation check valve 21 can be stably opened.

Further, by stably opening the operation check valve 21, a pressure loss of the first main passage 7 can be reduced.

Further, the axial size of the first land section 72 is set in such a manner that the outer periphery of the first land section 72 is brought into sliding contact with the inner periphery of the annular projecting section 71 at the same time when or after the second supply port 33 communicates with the fourth pressure chamber 67 by moving the spool 56 in the valve opening direction. Thus, only a change of the spool 56 of the existing meter-out control valve 22 is required, and the above generation of the pressure resistance can be prevented with a simple structure.

The embodiments of the present invention described above are merely illustration of some application examples of the present invention and not of the nature to limit the technical scope of the present invention to the specific constructions of the above embodiments.

For example, in the above embodiment, the working oil of the second supply port 33 is guided to the discharge port 34 via the fourth pressure chamber 67 and the conducting hole 68. However, as long as the second supply port 33 and the discharge port 34 communicate with each other in accordance with movement of the spool 56 in the valve opening direction, other configurations may be used.

Further, in the above embodiment, a case where the axial size of the first land section 72 is set in such a manner that the outer periphery of the first land section 72 is brought into sliding contact with the inner periphery of the annular projecting section 71 and the first supply port 32 and the discharge port 34 are blocked from each other at the same time when or after the second supply port 33 communicates with the discharge port 34 via the conducting hole 68 is shown as an example. Instead, by extending axial size of the second land section 73, a moving amount of the spool 56 required for opening the second supply port 33 in the fourth pressure chamber 67 may be increased. The axial size of both the first land section 72 and the second land section 73 may be adjusted.

The present application claims a priority based on Japanese Patent Application No. 2013-255853 filed with the Japan Patent Office on Dec. 11, 2013, all the contents of which are hereby incorporated by reference.

The invention claimed is:

1. A fluid pressure control device, comprising:

a cylinder configured to be extended and contracted by a working fluid supplied from a pump to drive a load;

a control valve configured to switch between supply and discharge of the working fluid to and from the cylinder to control an extending/contracting action of the cylinder;

a pilot valve configured to guide pilot pressure to the control valve;

a main passage configured to connect a load side pressure chamber of the cylinder on which load pressure by the load acts in a case where the control valve is at a blocking position, and the control valve; and a load holding mechanism placed in the main passage, the load holding mechanism being configured to hold the load pressure of the load side pressure chamber in a case where the control valve is at the blocking position, the load holding mechanism comprising:

an operation check valve configured to allow a flow of the working fluid from the control valve to the load side pressure chamber, and allows a flow of the working fluid from the load side pressure chamber to the control valve in accordance with pressure of a back pressure chamber to which the pressure of the load side pressure chamber is guided via a throttle passage; and a switching valve configured to be activated in conjunction with the control valve by the pilot pressure guided through the pilot valve to switch work of the operation check valve, the switching valve comprising:

a pilot chamber configured to which the pilot pressure is guided through the pilot valve;

a spool configured to be moved in a valve opening direction in accordance with the pilot pressure of the pilot chamber, the spool having a poppet section, a first land section, and a second land section in order from the front end side in the valve opening direction;

a bias member configured to bias the spool in the valve closing direction against the pilot pressure of the pilot chamber;

a spool hole having an annular projecting section on an inner periphery, the poppet section being configured to be seated on the annular projecting section in a case where the spool is closed, an outer periphery of the first land section being configured to be brought into sliding contact with the annular projecting section by moving the spool in the valve opening direction;

a first supply port configured to guide the working fluid from the load side pressure chamber to the spool hole while letting the working fluid bypass the operation check valve;

a second supply port configured to guide the working fluid from the back pressure chamber to the spool hole;

a discharge port configured to communicate with the first supply port or the second supply port in accordance with movement of the spool in the valve opening direction to discharge the working fluid;

a first pressure chamber in which the discharge port is opened;

a second pressure chamber configured to be blocked from the first pressure chamber by seating the poppet section on the annular projecting section;

a third pressure chamber in which the first supply port is opened, the third pressure chamber configured to be blocked from the second pressure chamber by the first land section in a case where the spool is closed, and to communicate with the second pressure chamber in accordance with the movement of the spool in the valve opening direction; and a communication passage configured to be blocked from the third pressure chamber by the second land section in a case where the spool is closed, and to provide communicate between the second supply port and the discharge port in accordance with the movement of the spool in the valve opening direction, wherein in a case where the spool is moved in the valve opening direction, at the same time when or after the second supply port communicates with the discharge port via the communication passage, the first land section is brought into sliding contact with the annular projecting section and the first supply port and the discharge port are blocked from each other.

2. The fluid pressure control device according to claim 1, further comprising:

a fourth pressure chamber to be blocked from the third pressure chamber by the second land section, the fourth pressure chamber in which the second supply port is configured to be opened in accordance with the movement of the spool in the valve opening direction; and a conducting hole formed in the axial direction in the spool, the conducting hole whose one end is opened in the fourth pressure chamber and whose other end is opened in the second pressure chamber, wherein the communication passage is formed from the fourth pressure chamber and the conducting hole.

3. The fluid pressure control device according to claim 2, wherein a length of the first land section in an axial direction is set in such a manner that the first land section is brought into sliding contact with the annular projecting section and the first supply port and the discharge port are blocked from each other at the same time when or after the second supply port communicates with the discharge port via the communication passage.

4. The fluid pressure control device according to claim 2, wherein a length of the second land section in an axial direction is set to prevent movement of the spool after the second supply port opens the fourth pressure chamber.

5. The fluid pressure control device according to claim 1, wherein the switching valve has three different positions including a first position in which both the first supply port and the second supply port are blocked from communicating with the discharge port, a second position in which the first supply port communicates with the discharge port while the second supply port is blocked from communicating with the discharge port, and a third position in which the second supply port communicates with the discharge port while the first supply port is blocked from communicating with the discharge port.

* * * * *